US008777559B2

(12) United States Patent
Koyabu et al.

(10) Patent No.: US 8,777,559 B2
(45) Date of Patent: Jul. 15, 2014

(54) COOLING SYSTEM OF RING SEGMENT AND GAS TURBINE

(75) Inventors: Hidemichi Koyabu, Tokyo (JP); Satoshi Hada, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 877 days.

(21) Appl. No.: 12/861,339

(22) Filed: Aug. 23, 2010

(65) Prior Publication Data

US 2011/0044805 A1 Feb. 24, 2011

Related U.S. Application Data

(60) Provisional application No. 61/236,310, filed on Aug. 24, 2009.

(51) Int. Cl.
*F01D 25/08* (2006.01)

(52) U.S. Cl.
USPC ..... 415/116; 415/175; 415/178

(58) Field of Classification Search
USPC ..... 415/115, 116, 170.1, 173.1, 175, 177, 415/178, 180
See application file for complete search history.

(56) References Cited

U.S. PATENT DOCUMENTS

| | | | | |
|---|---|---|---|---|
| 5,584,651 | A | 12/1996 | Pietraszkiewicz et al. | |
| 6,899,518 | B2 | 5/2005 | Lucas et al. | |
| 2004/0047725 | A1 * | 3/2004 | Tomita et al. | 415/116 |

FOREIGN PATENT DOCUMENTS

| | | | |
|---|---|---|---|
| JP | 11-022411 | A | 1/1999 |
| JP | 2000-257447 | A | 9/2000 |
| JP | 2004-100682 | A | 4/2004 |
| JP | 2007-516375 | A | 6/2007 |

OTHER PUBLICATIONS

International Search Report of PCT/JP2009/004990, dated Jan. 12, 2010 (5 pages).
Written Opinion of the International Searching Authority (PCT/ISA/237) dated Jan. 12, 2010 (6 pages) w/ English translation (4 pages).

* cited by examiner

*Primary Examiner* — Edward Look
*Assistant Examiner* — Maxime Adjagbe
(74) *Attorney, Agent, or Firm* — Westerman, Hattori, Daniels & Adrian, LLP

(57) ABSTRACT

A cooling system of ring segment is provided with: a collision plate that has a plurality of small holes; a cooling space that is enclosed by the collision plate and a main body of the segment body; a first cavity that arranged is the upstream end portion of the segment body in the flow direction of the combustion gas so as to be perpendicular to the axial direction of a rotating shaft; a first cooling passage that communicates from the cooling space to the first cavity; and a second cooling passage that communicates from the first cavity to a fire combustion gas d gas space in the downstream end portion of the segment body in the flow direction of the combustion gas.

16 Claims, 10 Drawing Sheets

COOLING SYSTEM OF RING SEGMENT AND GAS TURBINE

BACKGROUND OF THE INVENTION

1. Field of the Invention

The present invention relates to a cooling system of ring segment of a gas turbine and to a gas turbine.

2. Description of the Related Art

Conventionally, since combustion gas of a high temperature and high pressure passes through the turbine of a gas turbine, which is used in the generation of electrical energy, cooling of the ring segment and the like is important in order to continue stabilized operation. In particular, due to improvements in the thermal efficiency of gas turbines in recent years, the temperature of combustion gas continues to increase.

FIG. 11 is a cross-sectional view that shows the internal structure relating to the turbine of a gas turbine. The gas turbine supplies combustion gas FG generated in a combustor 3 to turbine vanes 7 and turbine blades 8, and by causing the turbine blades 8 to rotate around a rotating shaft 5, converts rotational energy into electrical power. The turbine vanes 7 and the turbine blades 8 are alternately disposed from the upstream to the downstream of the flow direction of the combustion gas FG. Moreover, a plurality of turbine blades 8 is disposed in the circumferential direction of the rotating shaft 5, and thus rotate together with the rotating shaft 5.

Moreover, the turbine vanes 7 are disposed on the upstream of the turbine blades 8 in the flow direction of the combustion gas FG, and a plurality are disposed in the circumferential direction of the rotating shaft 5, similarly to the turbine blades 8. A ring segment 60 is disposed annularly on the outer periphery side of the turbine blades 8, and between the ring segment 60 and the turbine blades 8, a tip clearance is provided in order to avoid mutual interference.

FIG. 12 is a cross-sectional view of a conventional ring segment. The ring segment 60 is formed from a plurality of segment bodies 61, and is oriented annularly in the circumferential direction of the rotating shaft 5. Each segment body 61 is supported by a casing 67 via hooks 62 of the segment body 61 and an isolation ring 66. Moreover, a collision plate 64 that is supported from the isolation ring 66 is equipped with a plurality of small holes 65. In the segment body 61, a plurality of cooling passages 63 are disposed in the axial direction of the rotating shaft 5.

In order to cool the ring segment 60, cooling air CA which is a portion of bleed air of a compressor is supplied to each segment body 61 of the ring segment 60 from a supply hole 68 of the casing 67. The cooling air CA jets into the space enclosed by the collision plate 64 and the segment body 61, through the small holes 65 opened in the collision plate 64, and carries out impingement cooling of the outer circumferential surface of the segment body 61. Furthermore, when the cooling air CA after the impingement cooling jets into the combustion gas space from the downstream end of the segment body 61 in the flow direction of the combustion gas (in the direction from the left side to the right side on the sheet of FIG. 11) via the cooling passage 63, convection cooling of the segment body 61 is carried out by the cooling air CA that flows through the cooling passage 63.

Japanese Unexamined Patent Document No. H11-22411 (hereinafter, Patent Document 1) discloses a ring segment that is provided with the abovementioned collision plate. An example is illustrated in which when the cooling air that that has performed impingement cooling is supplied to opening portions that are disposed in the outer circumferential surface of the ring segment (segment body) and discharged from the downstream end of the ring segment in the flow direction of the combustion gas FG to the combustion gas space via the cooling passage (cooling air holes), it cools the ring segment.

Japanese Unexamined Patent Document No. 2004-100682 (hereinafter, Patent Document 2) discloses a structure that is an improvement on that disclosed in Patent Document 1. A cooling passage (first passage) that jets a portion of cooling air that has performed impingement cooling from the upstream end of the ring segment (segment body) in the flow direction of the combustion gas to the combustion gas space is disclosed, and a cooling passage (second passage) that jets a greater part of the remaining cooling air after the impingement cooling from the downstream end in the flow direction of the combustion gas to the combustion gas space is disclosed. Thereby, cooling of the ring segment is enhanced.

However, in the invention disclosed in Patent Document 1, there is a region in which a cooling passage is not disposed on the upstream end portion of the ring segment in the flow direction of the combustion gas, and so in the case of the combustion gas further increasing in temperature, the problem arises of the upstream end portion of the ring segment being damaged thermally by the high temperature combustion gas.

Also, in the invention disclosed in Patent Document 2, when a portion of the cooling air after the impingement cooling is discharged from the upstream end portion of the ring segment in the flow direction of the combustion gas to the combustion gas space via the cooling passage (cooling air holes), it enhances the cooling of the upstream end portion of the ring segment. However, since the cooling air that is discharged to the upstream end side of the ring segment in the flow direction of the combustion gas is discharged to the combustion gas space cooling only the upstream end portion, the problem arises of it becoming a loss of the amount of cooling air, and an increase in the amount of cooling air leads to a reduction in the thermal efficiency of the gas turbine.

The present invention was achieved in view of the above problems, and has as its object to provide a cooling system of a ring segment that has as its object to prevent thermal damage of the ring segment as the combustion gas increases in temperature and improve the thermal efficiency by reducing the amount of cooling air, and a gas turbine.

SUMMARY OF THE INVENTION

The present invention adopts the following means in order to solve the aforementioned problem points.

That is, the cooling system of ring segment of the present invention is a ring segment cooling system that is formed from a plurality of segment bodies that are arranged in the circumferential direction to form a ring shape, and that cools a ring segment of a gas turbine that is arranged in a casing so that the inner peripheral surface is kept a fixed distance from the tips of turbine blades, is provided with: a collision plate that has a plurality of small holes; a cooling space that is enclosed by the collision plate and a main body of the segment body; a first cavity that is arranged in the upstream end portion of the segment body in the flow direction of the combustion gas so as to be perpendicular to the axial direction of a rotating shaft; a first cooling passage that communicates from the cooling space to the first cavity; and a second cooling passage that communicates from the first cavity to a combustion gas space in the downstream end portion of the segment body in the flow direction of the combustion gas.

The present invention provides the first cavity in the upstream end portion of the ring segment in the flow direction of the combustion gas, and since the cooling air of the cooling space is supplied to the first cavity via the first cooling passage, and furthermore discharged to the combustion gas space from the downstream end portion in the flow direction of the combustion gas via the second cooling passage, the length of the cooling passage is elongated, and the convection cooling of the upstream end portion of the segment body which has an intense heat load is enhanced. For that reason, thermal damage of the upstream end portion of the segment body by the high temperature combustion gas is avoided.

In the cooling system of ring segment of the present invention, it is preferable that the first cooling passage and the second cooling passage have a structure of turning back in the axial direction of the rotating shaft in the first cavity, and the second cooling passage passes the main body of the segment body in the axial direction of the rotating shaft from the first cavity, and opens on the surface of the down stream end portion of the segment body.

According to the present invention, since the first cooling passage and the second cooling passage have a structure of turning back in the flow direction of the combustion gas in the first cavity, and the second cooling passage passes the main body of the segment body in the axial direction of the rotating shaft from the first cavity, and opens on the surface of the down stream end portion of the segment body, the entirety of the cooling passage with a long passage length is put in the main body of the segment body in a compact manner, and miniaturization of the ring segment is achieved.

In the cooling system of ring segment of the present invention, it is preferable that the first cooling passage and the second cooling passage each be arranged in a plurality in an annular shape with respect to the rotation direction of the rotating shaft, and be arranged so as to be mutually parallel in the radial direction.

According to the present invention, since the first cooling passage and the second cooling passage are arranged so as to be mutually parallel, the distance between adjacent cooling passages is uniformly maintained, the temperature distribution of the upstream end portion diminishes, and the cooling performance of the upstream end portion of the segment body improves.

In the cooling system of ring segment of the present invention, it is preferable that the first cooling passage and the second cooling passage each be arranged in a plurality in an annular shape with respect to the rotation direction of the rotating shaft, and the first cooling passage be arranged sloping in the rotation direction of the rotating shaft with respect to the second cooling passage.

According to the present invention, since the cooling air that is supplied to the first cavity via the first cooling passage jets toward the bottom surface of the first cavity, and performs impingement cooling of the bottom surface of the first cavity, it is effective for cooling of the upstream end portion of the segment body where the heat load is intense.

In the cooling system of ring segment of the present invention, it is preferable that the first cooling passage has a shorter length than the second cooling passage and be disposed further to the outer circumferential surface side of the main body than the second cooling passage.

According to the present invention, since the first cooling passage is arranged at the outer circumferential surface side of the upstream end portion, and the second cooling passage is arranged at the inner circumferential surface side of the upstream end portion, the outer circumferential surface side and the inner circumferential surface side of the upstream end portion of the segment body are cooled together, and the cooling performance of the upstream end portion of the segment body improves.

In the cooling system of ring segment of the present invention, it is preferable that the hole diameter of the second cooling passage be smaller than the hole diameter of the first cooling passage.

According to the present invention, since it is possible to maintain a high pressure in the first cavity, it is possible to increase the velocity of the cooling air that flows through the second cooling passage, and the cooling performance of the inner circumferential surface side of the segment body improves.

In the cooling system of ring segment of the present invention, it is preferable that the hole pitch of the second cooling passage in the rotation direction of the rotating shaft be smaller than the hole pitch of the first cooling passage in the rotation direction of the rotating shaft.

According to the present invention, since the hole pitch of the second cooling passage in the rotation direction of the rotating shaft is smaller compared to the first cooling passage, the cooling effect of the second cooling passage is high, and the cooling performance of the segment body improves.

In the cooling system of ring segment of the present invention, it is preferable that a third cooling passage be arranged at the side end portion on the upstream of the segment body in the rotation direction of the rotating shaft, and that it communicate from the cooling space to the combustion gas space in the side end portion on the upstream of the segment body in the rotation direction of the rotating shaft.

According to the present invention, the convection cooling of the side end portion on the upstream of the segment body in the rotation direction of the rotating shaft is enhanced.

In the cooling system of ring segment of the present invention, it is preferable that a fourth cooling passage be arranged at the side end portion on the downstream of the segment body in the rotation direction of the rotating shaft, and that it communicate from the cooling space to the combustion gas space in the side end portion on the downstream of the segment body in the rotation direction of the rotating shaft.

According to the present invention, since providing the fourth cooling passage cools the side end portions of both sides of the upstream and the downstream of the segment body in the rotation direction of the rotating shaft, the convection cooling of the segment body is enhanced.

In the cooling system of ring segment of the present invention, it is preferable that the third cooling passage or the fourth cooling passage communicate with the first cavity via the second cavity or the third cavity.

According to the present invention, since a portion of the high pressure cooling air that is supplied to the first cavity is supplied to the third cooling passage of the fourth cooling passage via the second cavity or the third cavity, the cooling performance of the third cooling passage or the fourth cooling passage in the vicinity of the upstream end portion is enhanced.

A gas turbine of the present invention is preferably provided with the aforementioned cooling system of ring segment.

According to the present invention, the amount of cooling air of the gas turbine is reduced, and the thermal efficiency of the gas turbine improves.

According the aforementioned present invention, the cooling of the upstream end portion of the ring segment is enhanced, and thermal damage of the ring segment is avoided. Also, it is possible to provide a gas turbine that keeps down the amount used of cooling air to a minimum, and further increases the cooling efficiency and cooling performance of a ring segment. Accordingly, it is possible to improve the reliability and the operating efficiency of a gas turbine.

DETAILED DESCRIPTION OF THE INVENTION

Hereinbelow, regarding the cooling system of ring segment and gas turbine of the present invention, the embodiments thereof shall be described based on FIG. 1 to FIG. 11.

First Embodiment

A description of the first embodiment shall be given based on FIGS. 1 to 7 and FIG. 11.

Figure 1:
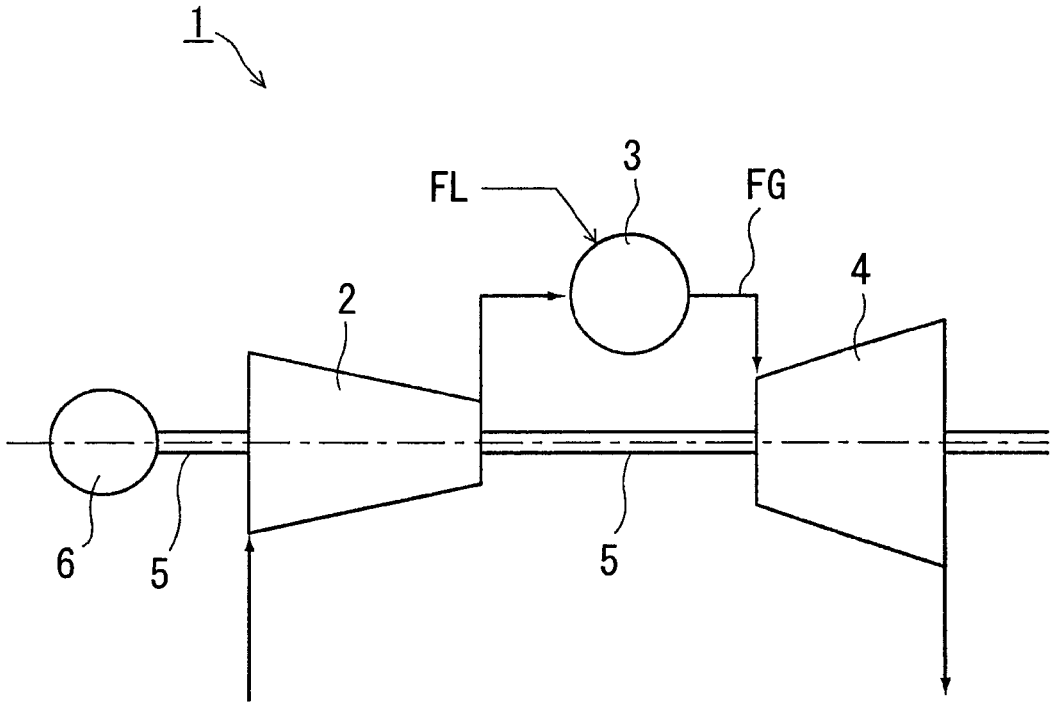
FIG. 1 shows the overall configuration of a gas turbine according to the present invention.

FIG. 1 is an overall configuration diagram of the gas turbine. A gas turbine 1 has as main constituent elements a compressor 2 that compresses combustion air, a combustor 3 that injects fuel FL into the combustion air that is sent from the compressor 2, causes a combustion, and generates combustion gas, a turbine 4 that is positioned on the downstream of this combustor 3 and driven by the combustion gas that has left the combustor 3, a generator 6, and a rotating shaft 5 that integrally couples the compressor 2, the turbine 4, and the generator 6.

Figure 11:
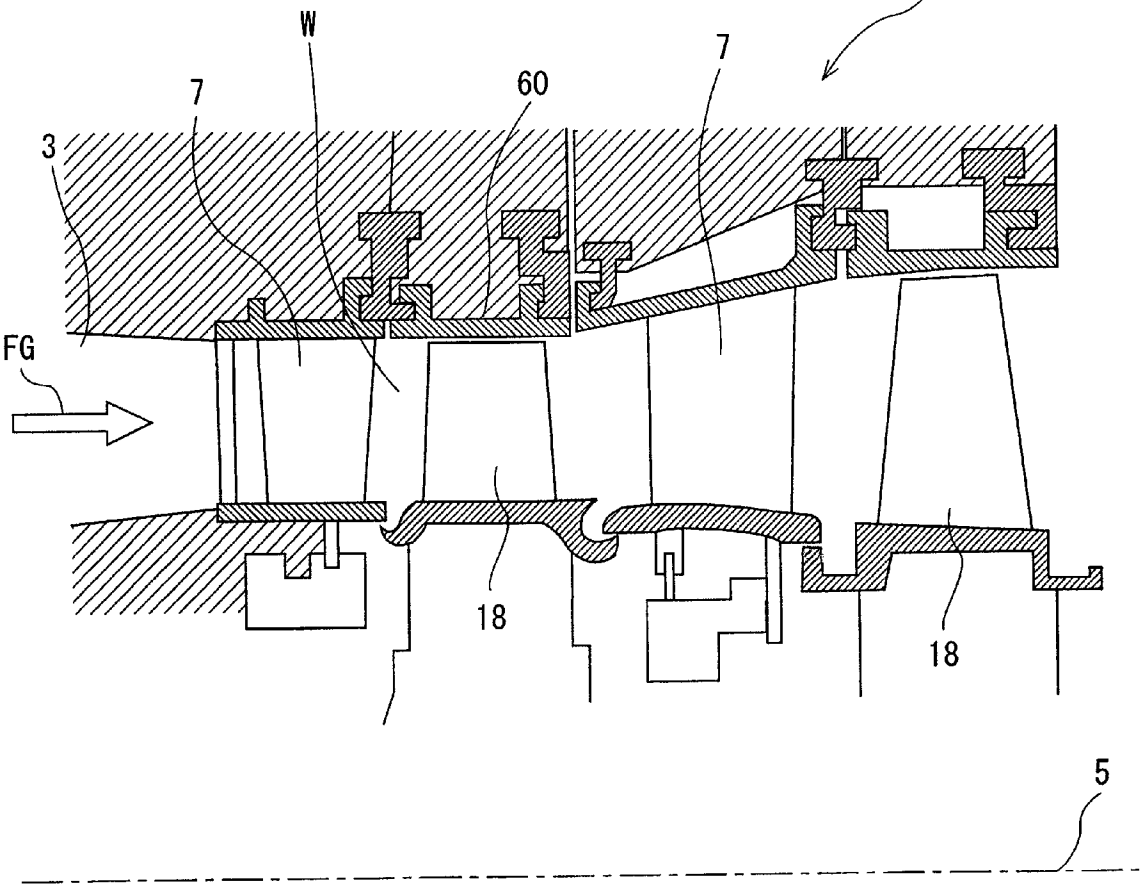
FIG. 11 shows the cross-sectional structure of the turbine.
Figure 12:
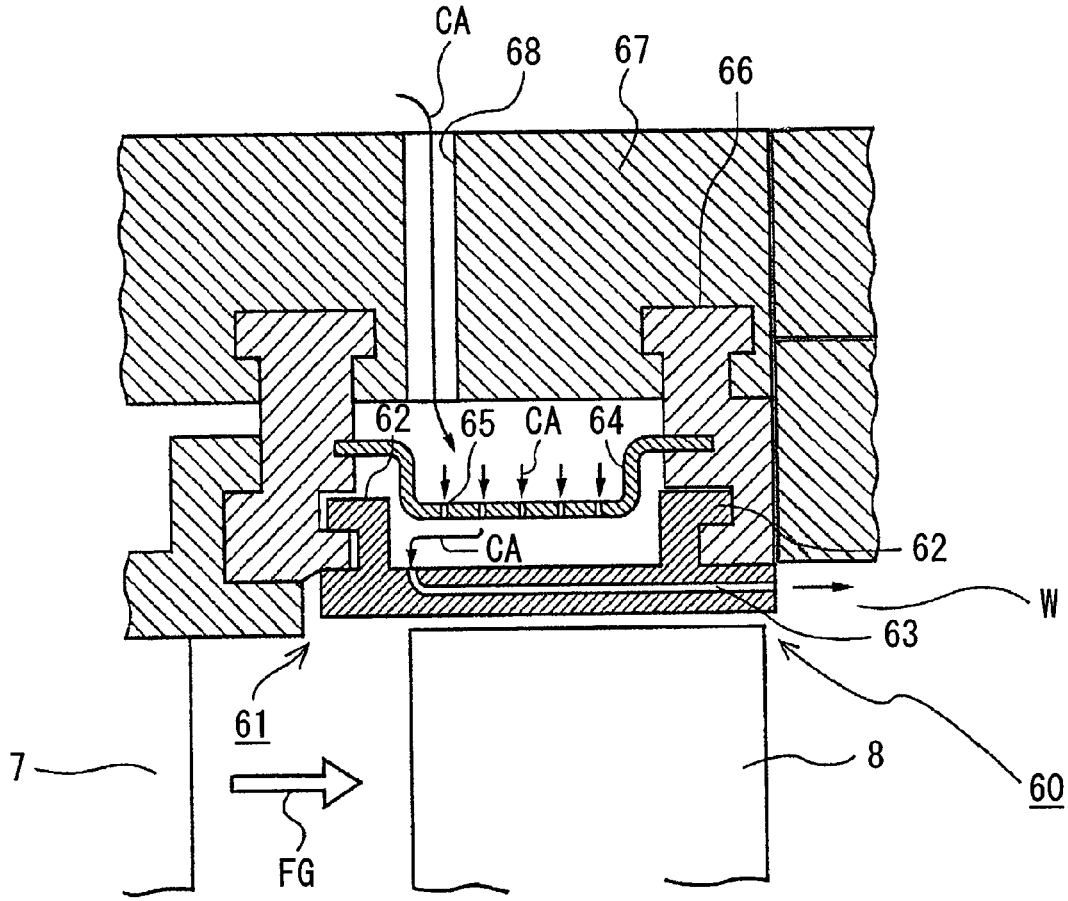
FIG. 12 shows the essential portion cross-sectional view of a ring segment of a conventional example.

Since the turbine 4 has the same constitution as the content described in FIG. 11 of the background art, a detailed description thereof shall be omitted. The same names and reference numerals shall be used for common component names and reference numerals.

Figure 2:
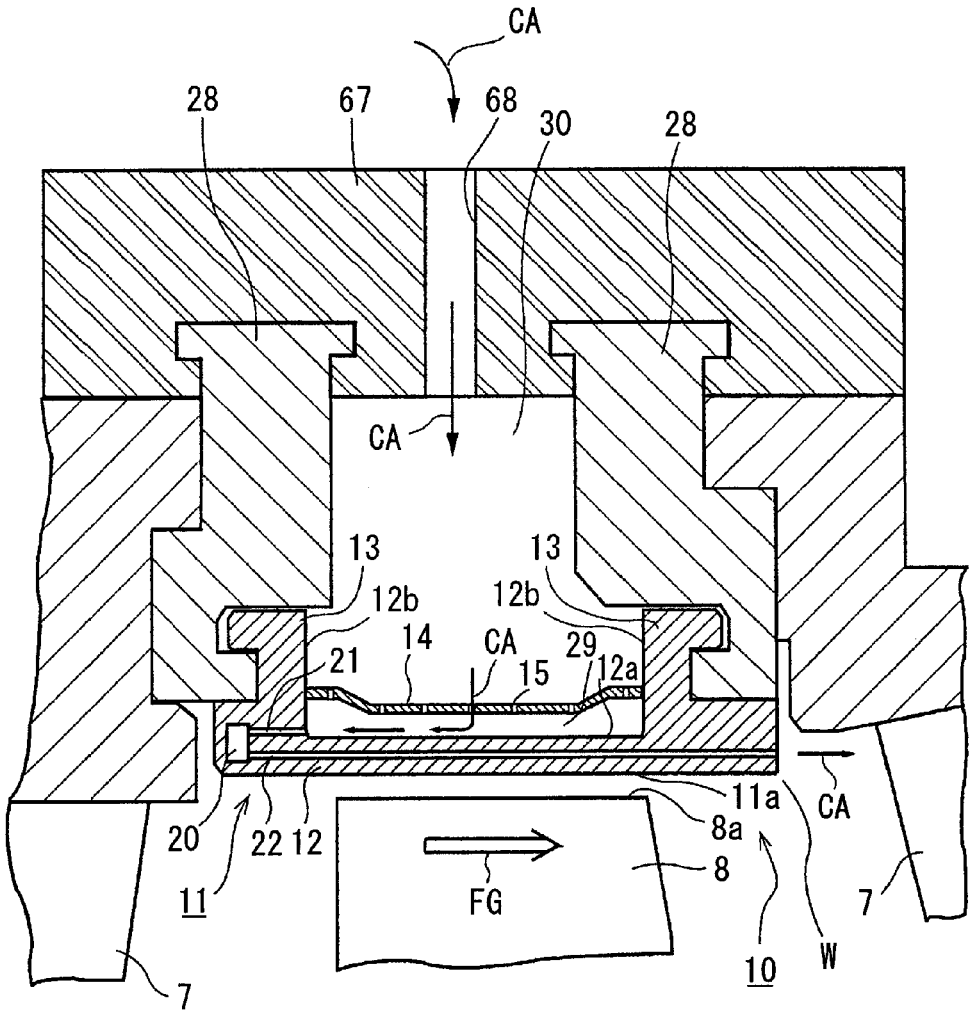
FIG. 2 shows the essential portion cross-sectional view of the ring segment of the first embodiment.

FIG. 2 shows a cross section of the essential portions of the ring segment of the gas turbine.

A ring segment 10 is a constituent member of the turbine 4 that is supported by the casing 67, and is constituted by a plurality of segment bodies 11 that are arranged in the circumferential direction of a rotating shaft 5 to form a ring shape. The segment bodies 11 are positioned so that a fixed clearance is secured between the inner peripheral surface 11*a* of the segment bodies and a tip 8*a* of a rotor blade 8. The ring segment 10 is formed for example from a heat-resistant nickel alloy or the like. Note that the reference numeral 7 in the drawing denotes turbine vanes of the turbine 4.

In the segment body 11, the main constituent elements are a main body (bottom plate) 12, hooks 13, and a collision plate 14. The segment body 11 is attached to a isolation ring 28 via the hooks 13 that are provided on the upstream and downstream in the flow direction of the combustion gas FG, and is supported by the casing 67 via a isolation ring 28. The segment body 11 is provided with the main body 12, the collision plate 14, the hooks 13 that are arranged on the upstream and downstream in the flow direction of the combustion gas FG, and a cooling space (hereinbelow called a "cooling space") 29 that is enclosed by side end portions 18 an 19 (refer to FIG. 4) that are provided on the upstream and downstream of the direction that is approximately perpendicular with the axial direction of the rotating shaft 5 (the rotation direction of the rotating shaft 5). The cooling space 29 is formed in the segment body 11, and is a space that is in contact with an outer circumferential surface 12*a* side of the main body 12 that is positioned on the rear surface (outer peripheral surface), viewing from the inner peripheral surface 11*a* of the segment body 11.

The collision plate 14 is installed on the upper portion of the cooling space 29. A large number of the small holes 15 through which the cooling air CA for impingement cooling passes are bored in the collision plate 14. Above the collision plate 14, a reception space 30 is arranged in which cooling air CA in the casing 67 is introduced via a supply hole 68. The cooling air CA that is supplied to the reception space 30 jets from the small holes 15 in the state of the entirety being equalized to approximately the same pressure, and performs impingement cooling of the inner circumferential surface (outer circumferential surface 12*a* of the main body 12) of the cooling space 29.

Figure 3:
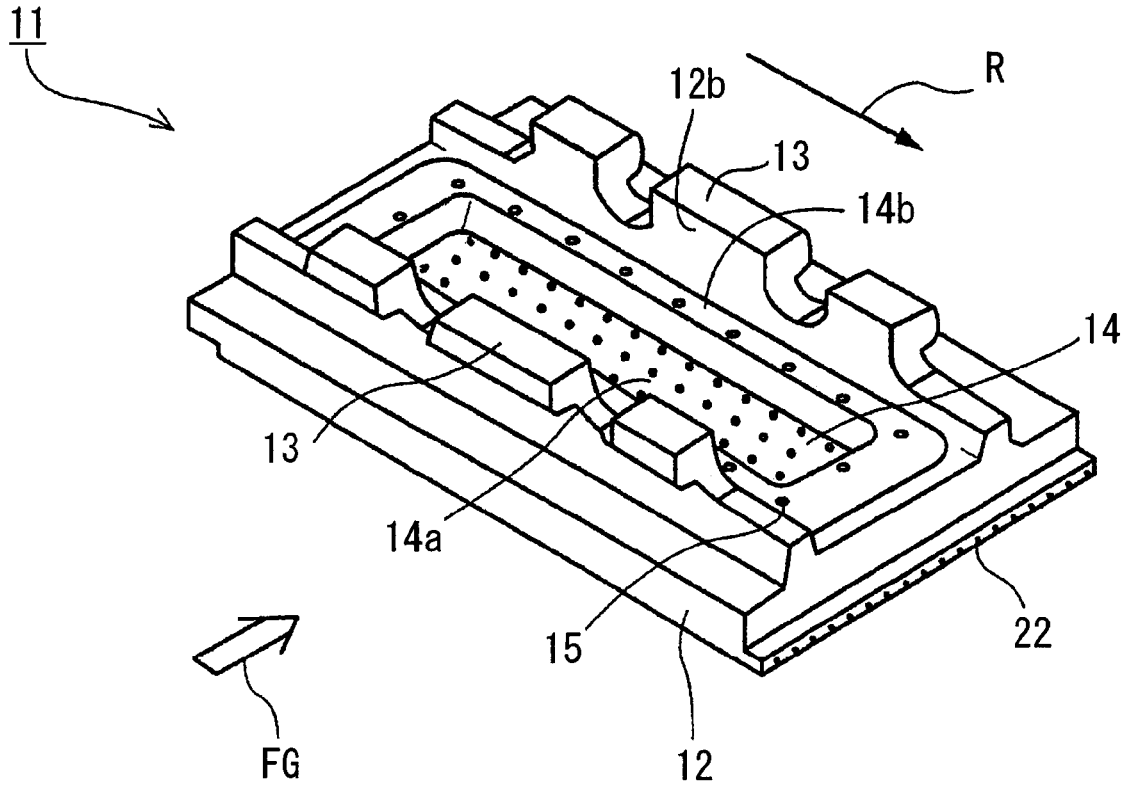
FIG. 3 shows a perspective view of the segment body of the first embodiment.

FIG. 3 is a perspective view of the segment body 11. The combustion gas FG flows in the direction from the left side to the right side on the sheet surface, and the rotation direction (rotation direction of the turbine blades) R of the rotating shaft 5 is a direction that is perpendicular to the axial direction of the rotating shaft. As stated above, the segment body 11 is supported by the isolation ring 28 via the hooks 13. Also, in the center of the segment body 11, the collision plate 14 is fixed to inner walls 12*b* of the main body 12 of the segment body 11.

The collision plate 14 has a shape in which the center portion 14*a* is indented in a concave shape from the periphery 14*b*. That is, since the main body 12 of the segment body 11 is placed in a higher temperature state than the collision plate 14, thermal elongation becomes larger than the collision plate 14 in the axial direction of the rotating shaft and the rotation direction R of the rotating shaft. For that reason, the collision plate 14 is pulled from the inner wall 12*b* side of the main body 12, and thermal stress occurs in the collision plate 14. However, by providing the indentation in a concave shape in the center portion 14*a* of the collision plate 14, the flexibility of the entire collision plate 14 increases, and so there is the effect of the thermal stress that is generated being eased. Even in the case of the center portion 14*a* of the collision plate 14 being formed in a concave shape, there is the same effect. Note that in order to make the impingement cooling uniform over the entire surface of the outer circumferential surface 12*a* of the main body 12, it is desirable to provide the small holes 15 not only in the center portion 14*a* of the collision plate 14 but also in the periphery 14*b*.

Figure 4:
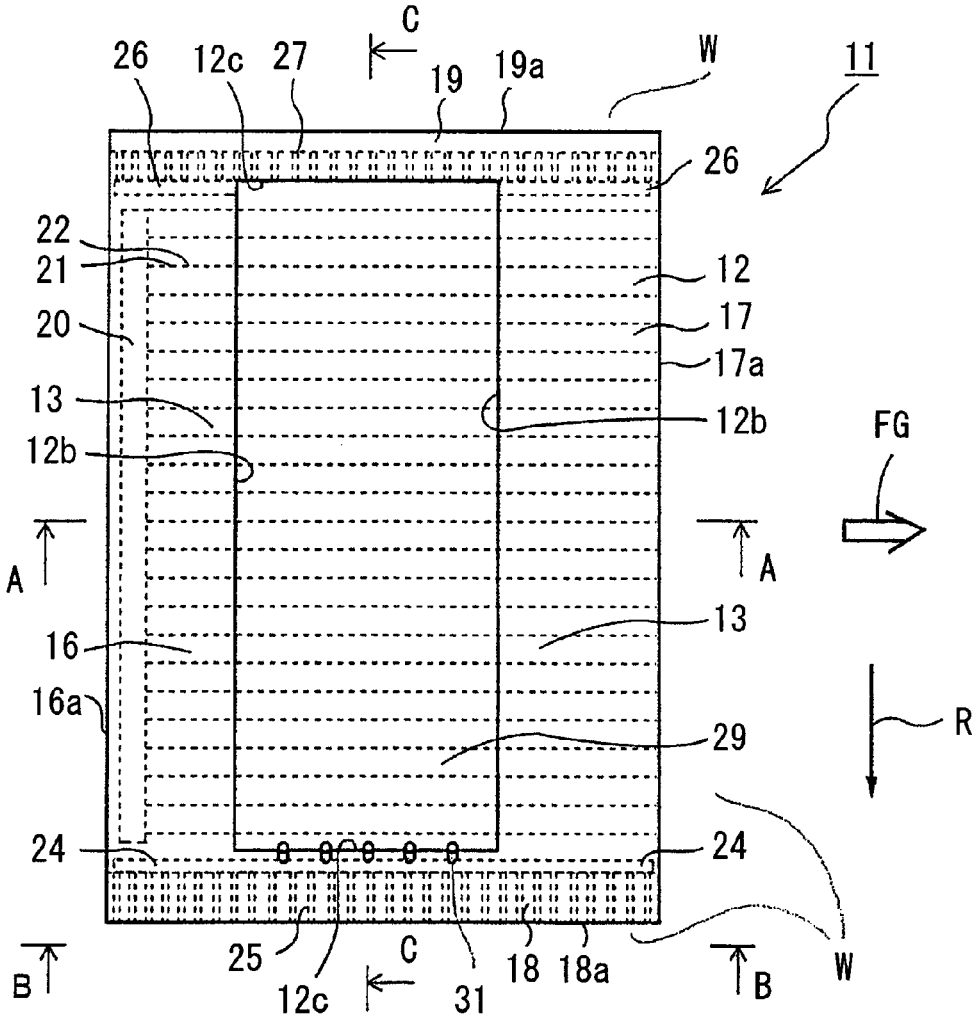
FIG. 4 shows a plan view of the segment body of the first embodiment.

FIG. 4 is a plan view of the segment body viewed in the direction of the rotating shaft from the collision plate side of the segment body 11. In the segment body 11 of the present embodiment, at the upstream end portion 16 on the upstream in the flow direction of the combustion gas FG, a first cavity 20 is arranged in a direction approximately perpendicular to the axial direction of the rotating shaft 5. Also, a cooling passage (first cooling passage) 21 that couples the cooling space 29 and the first cavity 20 is provided in the axial direction of the rotating shaft 5, and a cooling passage (second cooling passage) 22 that opens from the first cavity 20 to a downstream end portion 17 of the downstream in the flow direction of the combustion gas FG is arranged in the axial direction of the rotating shaft. The first cavity 20 plays the role of a manifold that mutually couples the first cooling passage 21 and the second cooling passage 22.

Figure 5:
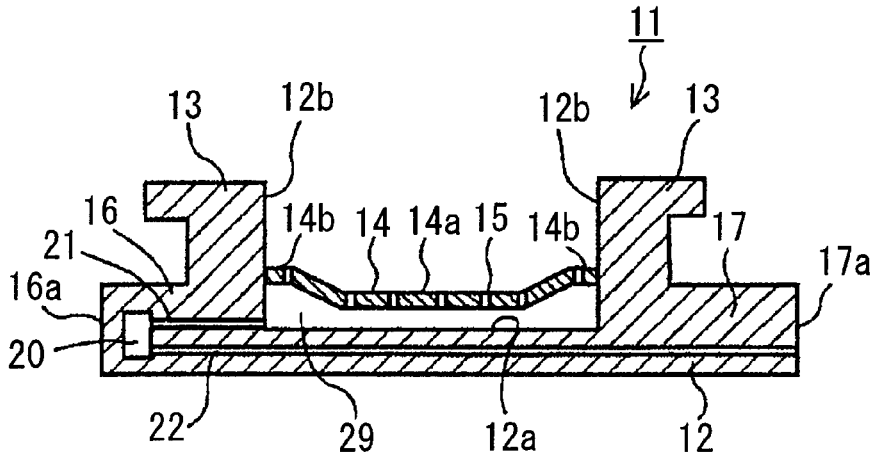
FIG. 5 shows a cross-sectional view along line A-A of the segment body shown in FIG. 4.
Figure 6:
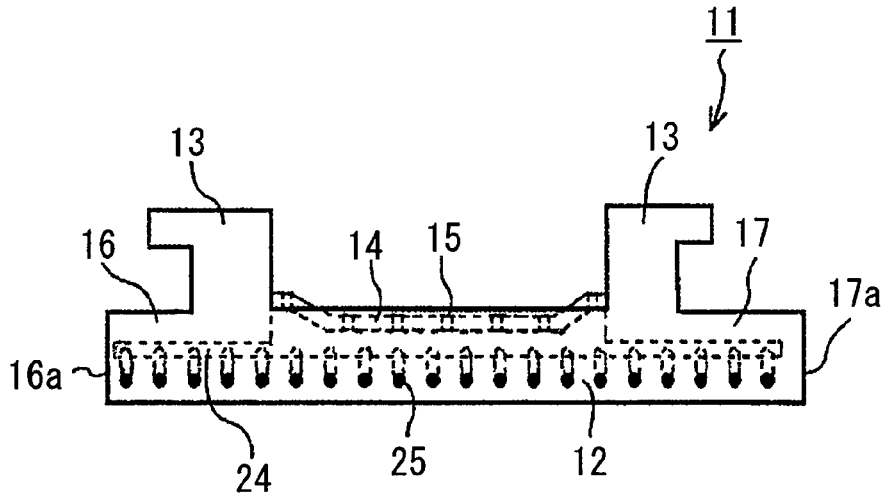
FIG. 6 shows a cross-sectional view along line B-B of the segment body shown in FIG. 4.
Figure 7:
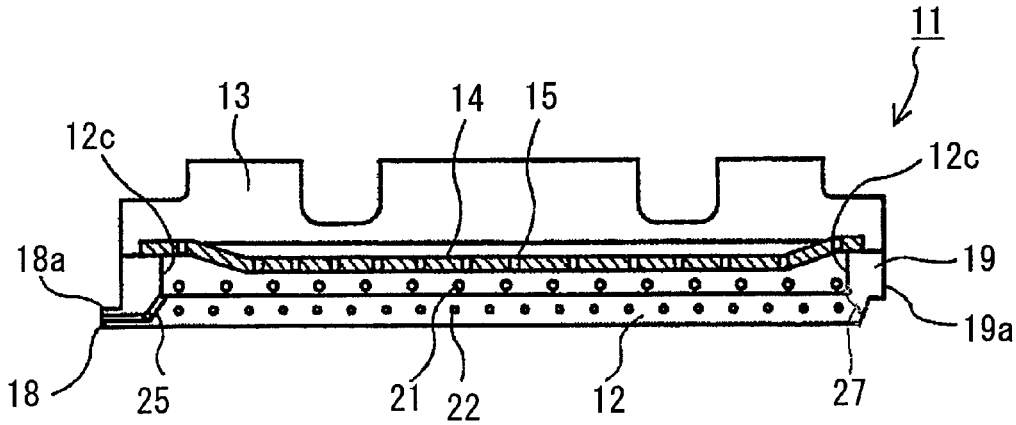
FIG. 7 shows a cross-sectional view along line C-C of the segment body shown in FIG. 4.

FIG. 5 shows a cross section of the segment body shown in FIG. 4 (cross section along line A-A), and FIG. 6 shows a side view (cross section along line B-B). FIG. 7 shows a cross section of the segment body viewed from the axial direction of the rotating shaft 5 (cross section along line C-C).

The structures of the first cooling passage 21 and the second cooling passage 22 shall be described with reference to FIG. 4 to FIG. 7. In the upstream end portion 16 on the upstream of the flow direction of the combustion gas FG with respect to the segment body 11 (the direction heading from the left side to the right side on the sheet surface in FIG. 4), the first cooling passage 21 and the second cooling passage 22 are both bored so as to pass through the cross section of the main body 12 of the segment body 11 in the axial direction of the rotating shaft 5.

Also, as shown in FIG. 7, the first cooling passage 21 and the second cooling passage 22 are arranged in parallel at a regular interval so as to mutually form one row in the vertical direction (the diameter direction of the rotating shaft 5), in the cross-sectional view seen from the axial direction of the rotating shaft 5. Also, for both the first cooling passage 21 and the second cooling passage 22, a plurality of the cooling passages 21 and 22 are arranged in an annular shape at a predetermined hole pitch with respect to the rotation direction R of the rotating shaft 5. That is, at the upstream end portion 16 of the segment body 11, the first cooling passage 21 and the second cooling passage 22 are arranged so as to overlap in two rows in the vertical direction from the side end portion 18 on the upstream in the rotation direction R of the segment body 11 to the side end portion 19 on the downstream. Also, as for the first cooling passage 21 and the second cooling passage 22, adjacent cooling passages are arranged at a predetermined hole pitch so as to be mutually parallel in the rotation direction R of the rotating shaft 5. Furthermore, the first cooling passage 21 and the second cooling passage 22 are arranged so as to be mutually parallel in the axial direction of the rotating shaft 5.

Also, the cooling passage that is arranged in the axial direction of the rotating shaft 5 (second cooling passage 22) is provided along the inner circumferential surface 11*a* of the segment body 11, from the first cavity 20 to the downstream end portion 17, in the portion excluding the upstream end portion 16 and the side end portions 18 and 19 of the main body 12 of the segment body 11. The second cooling passage 22, at the upstream end portion 16, in the cross-sectional view seen from the axial direction of the rotating shaft 5, is aligned so as to overlap in the vertical direction with the first cooling passage 21, is extended as is until the downstream end portion 17 on the downstream in the flow direction of the combustion gas, and opens to the combustion gas space W at a downstream end face 17*a*. Note that the upstream end portion 16 of the segment body 11 refers to the portion of the segment body 11 that is sandwiched by an upstream end face 16*a* and the inner wall 12*b* on the upstream of the main body 12, and beneath the installation height of the collision plate 14. Also, note that the downstream end portion 17 of the segment body 11 refers to the portion of the segment body 11 that is sandwiched by the downstream end face 17*a* and the inner wall 12*b* on the downstream of the main body 12, and beneath the installation height of the collision plate 14.

With the constitution of the first cooling passage and the second cooling passage as described above, since the first cooling passage 21 has a turn-back structure of turning back at the first cavity 20 to be coupled to the second cooling passage 22 and the second cooling passage 22 passes the main body 12 of the segment body 11 in the axial direction of the rotating shaft 5 from the first cavity 20, and opens on the surface of the down stream end portion 17 of the segment body 11, it is possible to select a cooling passage with a long passage length with respect to the axial direction of the rotating shaft 5. That is, the first cooling passage 21 is arranged in the segment body 11 close to the outer circumferential surface side of the upstream end portion 16 of the segment body 11. Meanwhile, the first cooling passage 21 turns back at the first cavity 20 to connect to the second cooling passage 22, and is arranged in the segment body 11 closer to the inner circumferential surface side than the first cooling passage 21 of the upstream end portion 16, and is extended until the downstream end face 17*a*. As a result, the longest passage length of the cooling passage of the present embodiment can be selected in the axial direction of the rotating shaft 5 compared to Patent Document 1 and Patent Document 2, and is effective in improving the cooling performance of the segment body.

Also, since there is a structure in which the first cooling passage 21 and the second cooling passage 22 turn back in the axial direction of the rotating shaft 5 via the first cavity 20, it is possible to put a cooling passage with a long passage length in the main body of the segment body in a compact manner, and it is possible to efficiently cool the segment body.

Next, the structure of a cooling path that is provided in the side end portions 18 and 19 of the segment body 11 shall be described.

As shown in FIG. 4, in the side end portion 18 on the upstream of the segment body 11 in the rotation direction R of the rotating shaft, a third cooling passage 25 communicating from the cooling space 29 to the combustion gas space W is arranged in a direction approximately perpendicular to the rotating shaft. One side of the third cooling passage 25 communicates with the cooling space 29, and the other side opens to the combustion gas space W. Also, in the upstream end portion 16 and the downstream end portion 17, a second cavity 24 is formed in which one side communicates with the cooling space 29, and the other end side extends in the axial direction of the rotating shaft, with the end being blocked, and a portion of the third cooling passage 25 communicates with the cooling space 29 via the second cavity 24.

In the present embodiment, it is possible to also constitute a fourth cooling passage 27 in the side end portion 19 on the downstream of the segment body 11 in the rotation direction R in the same manner as the third cooling passage 25. That is, one side of the fourth cooling passage 27 communicates with the cooling space 29, and the other side opens to the combustion gas space W. Also, in the upstream end portion 16 and the downstream end portion 17, a third cavity 26 is formed in which one side communicates with the cooling space 29, and the other end side extends in the axial direction of the rotating shaft, with the end being blocked, and a portion of the third cooling passage 25 communicates with the cooling space 29 via the third cavity 26. Note that depending on the operation condition of the gas turbine, convection cooling of the side end portion 19 may be omitted without providing a cooling passage in the side end portion 19 on the downstream in the rotation direction R of the aforementioned segment body 11.

Note that the side end portion 18 refers to the portion that is sandwiched by the inner wall 12*c* of the main body 12 on the upstream of the rotation direction R and the upstream end face 18*a*, and beneath the installation height of the collision plate 14. Also, the side end portion 19 refers to the portion that is sandwiched by the inner wall 12*c* of the main body 12 on the downstream of the rotation direction R and the downstream end face 19*a*, and beneath the installation height of the collision plate 14.

The flow of cooling air in the present embodiment is described below. As shown in FIG. 2, a portion of the cooling air CA that is supplied to the turbine 4 is supplied to the reception space 30 via the supply hole 68. The cooling air CA jets into the cooling space 29 via the small holes 15 that are provided in the collision plate 14, and performs impingement cooling of the outer circumferential surface 12*a* of the main body 12 of the segment body 11. A large part of the cooling air CA after the impingement cooling is supplied to the first cooling passage 21 that is provided in the upstream end portion 16, and that opens to the inner wall 12*a* on the upstream in the flow direction of the combustion gas FG of the main body 12 of the segment body 11, and by flowing in the reverse direction to the flow direction of the combustion gas FG, mainly performs convection cooling of the outer circumferential surface side of the upstream end portion 16, and is then once blown out to the first cavity 20.

The cooling air CA in the first cavity 20 turns back in the first cavity 20, and in a cross-sectional view seen from the axial direction of the rotating shaft 5, is supplied to the second cooling passage 22 that is provided below the first cooling passage 21. Moreover, the cooling air CA flows toward the downstream end portion 17 of the segment body 11 along the inner circumferential surface 11*a* of the segment body 11, performs convection cooling mainly of the inner circumferential surface side of the segment body 11, and is discharged to the combustion gas space W from the downstream end face 17*a*. That is, since it is provided with the turn-back structure as described above, it is possible to select a cooling passage with a long passage length, and is effective in cooling of the segment body.

Meanwhile, the pressure of the combustion gas FG of the segment body 11 changes along the flow direction. The pressure is highest in the vicinity of the upstream end face 16*a* at the upstream of the combustion gas FG flow direction, and the pressure is lowest in the vicinity of the downstream end face 17*a* at the downstream. Namely, in the example shown in the Patent Document 2, since the cooling air CA from the cooling space 29 flows through the upstream end portion 16 toward the upstream of the flow direction of combustion gas FG, and is discharged from the upstream end face 16*a* to the combustion gas space W, it is not possible to have a large pressure difference between the pressure of the cooling air CA in the cooling space 29 and the pressure of the combustion gas near the upstream end face 16*a*. Therefore, in order to sufficiently cool the upstream end portion 16, it is necessary to pass more cooling air that flows through the inside of the first cooling passage 21, which causes an increase in the amount of cooling air by that much.

On the other hand, in the case of the present embodiment, in order to cool the upstream end portion 16, the cooling air CA of the cooling space 29 is supplied via the first cooling passage 21 to the first cavity 20, and by being turned back in the first cavity 20 without being discharged as is from the upstream end face 16*a* to the combustion gas space W, is discharged to the downstream end face 17*a* via the second cooling passage 22. That is, since the cooling air CA is discharged to the combustion gas space W at the downstream end face 17*a* where the combustion gas pressure is the lowest, since it is possible to utilize to the utmost the pressure differential between the cooling air in the cooling space 29 and the combustion gas in the vicinity of the downstream end face 17*a*, it is possible to increase the flow velocity in the cooling passage, and it is possible to substantially reduce the amount of cooling air, compared to the examples of Patent Document 1 and Patent Document 2.

On the other hand, in the side end portions 18 and 19 of the segment body 11, when a portion of the cooling air CA which has carried out impingement cooling in the cooling space 29 is discharged to the combustion gas space W through the third cooling passage 25 and the fourth cooling passage 27, it carries out convection cooling of the side edge portions 18 and 19. Also, in a portion of the side end portions 18 and 19, the cooling air CA introduced from the cooling space 29 is once supplied to the second cavities 24 and 26, and supplied to the third cooling passages 25 and 27 through the second cavities 24 and 26. When discharging cooling air CA from the third cooling passage 25 to the combustion gas space W, convection cooling of the side end portions 18 and 19 is carried out.

Note that in the embodiment shown in FIG. 4, the cooling air that is supplied from the cooling space 29 to the second cavity 24 is supplied through connecting paths 31, but a method of carrying out direct introduction from the cooling space 29 may be used in the same manner as the third cavity 26.

As for cooling air having as its object convection cooling of the side end portions 18 and 19, since high pressure cooling air after impingement cooling is supplied to the third cooling passage 25 and the fourth cooling passage 27, it is possible to use the differential pressure between the cooling air of the cooling space 29 and the combustion gas near the side end portion end faces 18*a* and 19*a*, and it is effective in cooling of a side edge portion.

According to the present embodiment, it is possible to adopt the longest cooling passage length in the axial direction of the rotating shaft, and since it is possible to utilize to the utmost the differential pressure of the cooling air, it is most effective for cooling of the segment body.

Also, in the upstream end portion, since the first cooling passage and the second cooling passage are disposed so as to overlap in the vertical direction, the first cooling passage is arranged on the outer circumferential surface side, and the second cooling passage is arranged on the inner circumferential surface side, the cooling performance in the upstream end portion is improved.

Also, since the first cooling passage and the second cooling passage are arranged to be mutually parallel with respect to the vertical direction (radial direction of the rotating shaft), and a plurality are arrayed to be parallel at the same hole pitch with respect to the rotation direction R of the rotating shaft, the cooling passages are arranged at the same interval amongst themselves, and the temperature distribution in the upstream end portion becomes smaller, and uniform cooling is possible.

First Modification

Figure 8:
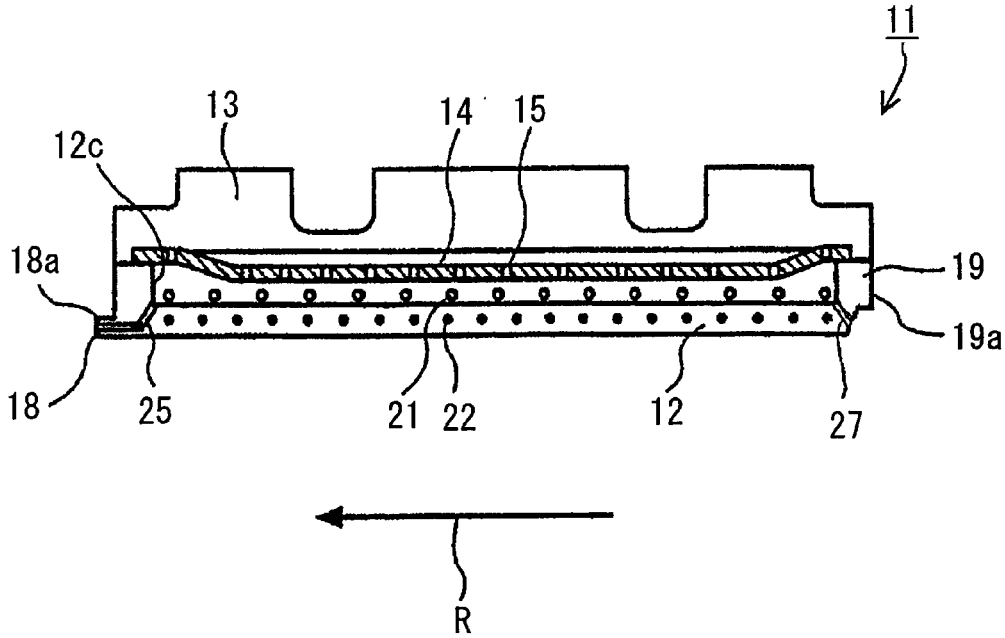
FIG. 8 shows a cross-sectional view along line C-C of the segment body of the first modification.

FIG. 8 shows an arrangement example that differs from the first embodiment, in relation to the first cooling passage and the second cooling passage. The first modification, compared to the first embodiment, is the same on the point of arranging cooling passages in an annular shape at the same hole pitch with respect to the rotation direction R of the rotating shaft 5, but differs on the point of the second cooling passage 22 having a smaller hole diameter than the first cooling passage 21. Also, it differs on the point of the hole pitch of the second cooling passage 22 in the rotation direction R of the rotating shaft 5 being greater than the hole pitch of the second cooling passage 22 in the rotation direction R. If these hole diameters and hole pitches of the first cooling passage 21 and the second cooling passage 22 are adopted, a sufficient amount of the cooling air that is supplied to the second cooling passage is secured for cooling, and compared to the first embodiment, the cooling performance of the main body (bottom surface) side of the segment body is improved.

That is, in the main body of the segment body, cooling of the upstream end portion 16 of the main body 12 in particular is the greatest difficulty, and that which contributes the most to cooling of the main body is the second cooling passage 22. In order to improve the cooling performance of the ring segment, it is desirable to adopt a small hole diameter as the cooling passage, and make the hole pitch narrow. In the case of the present modification, by making the hole diameter of the first cooling passage 21 relatively larger than that of the second cooling passage 22, and reducing the pressure loss in the first cooling passage, the cooling air pressure in the first cavity 20 is made as high as possible. Meanwhile, the hole diameter of the second cooling passage 22 is smaller than that of the first cooling passage 21, and the hole pitch reduced. As a result, in the second cooling passage 22, the pressure loss of the cooling air increases due to the small hole diameter, but since it is possible to utilize the differential pressure with the combustion gas side to the utmost by maintaining the pressure in the first cavity 20 at a high pressure, the cooling efficiency of the entire second cooling passage improves, and compared with the first embodiment, the cooling of the main body (bottom surface) of the segment body is enhanced.

Second Embodiment

Figure 9:
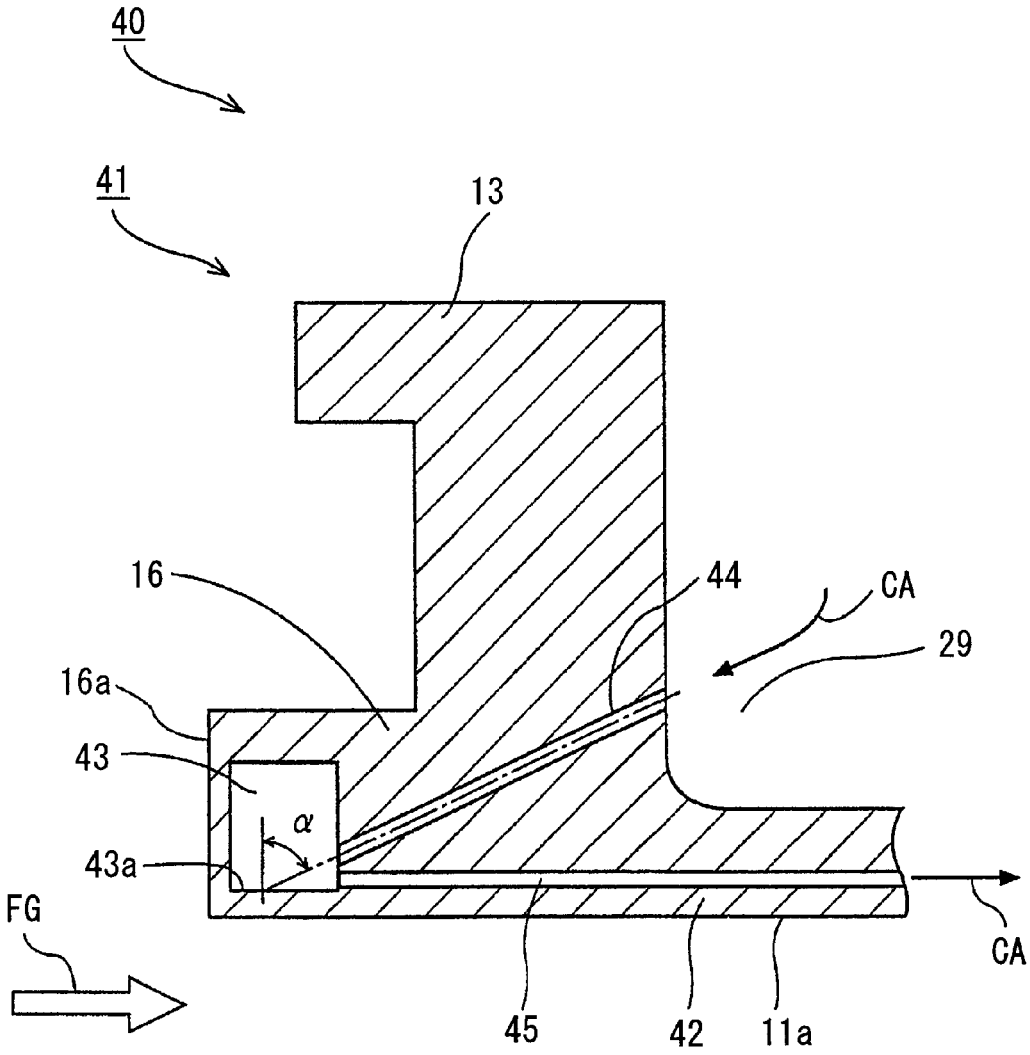
FIG. 9 shows a partial cross-sectional view of the upstream end portion of the segment body of the second embodiment.

FIG. 9 shows a partial cross-section of the upstream end portion of the segment body of the second embodiment.

Compared to the first embodiment, the present embodiment differs on the point of the first cooling passage having a slope in the axial direction of the rotating shaft with respect to the second cooling passage, and in other aspects is the same as the first embodiment. Note that the component elements that are in common with the first embodiment use the same component names and reference numbers as the first embodiment, and detailed descriptions thereof shall be omitted.

In FIG. 9, it is the same as the first embodiment on the point of a second cooling passage 45 being arranged in the axial direction of the rotating shaft 5 along the inner circumferential surface 11*a* of the segment body 11 until the downstream end face 17*a*, and being arranged in an annular shape at the same hole pitch in the rotation direction R of the rotating shaft. However, it differs on the point of a first cooling passage 44 that communicates with a first cavity 43 having a slope in the axial direction of the rotating shaft 5 heading toward the upstream end face 16*a*, and intersecting the bottom surface 43*a* of the first cavity 43 at an angle α. Note that it is the same as the first embodiment on the point of a plurality of the cooling passages being arranged in an annular shape along the inner circumferential surface 11*a* of the segment body 11 with respect to the rotation direction R of the rotating shaft for both the first cooling passage 44 and the second cooling passage 45.

According to the aforementioned constitution, the cooling air CA that is blown out from the cooling space 29 to the bottom surface 43*a* of the first cavity 43 via the first cooling passage 44 acts as impingement cooling air on the bottom surface 43*a* of the first cavity 43, and so the cooling of the upstream end portion 16 is enhanced compared to the first embodiment.

That is, the cooling air CA that is introduced from the cooling space 29 flows down the first cooling passage 44 that has a downward slope toward the upstream end portion 16*a* and reaches the first cavity 43, with the outer circumferential surface side of the upstream end portion 16 being cooled in the interim. Moreover, the cooling air CA, by colliding with the bottom surface 43*a* of the first cavity 43, imparts an impingement cooling effect on the bottom surface 43*a* to enhance the cooling of the upstream end portion 16.

The cooling air CA that turns back from the first cavity 43 flows toward the downstream in the flow direction of the combustion gas FG via the second cooling passage 45, and is discharged to the combustion gas space W from the downstream end portion 17. That is, as shown in FIG. 9, in the case of the present embodiment, the first cooling passage 44 has with respect to the second cooling passage 45 a downward slope toward the bottom surface 43*a* of the first cavity 43 in the axial direction of the rotating shaft 5, and thereby the cooling air CA that flows in the first cooling passage 44 imparts an impingement cooling effect in the first cavity 43 compared to the first embodiment. As a result, the cooling of the upstream end portion 16 is enhanced over the entire width of the segment body 11 in the rotation direction R, and the amount of cooling air of the ring segment can be further decreased.

Also, in the present embodiment, it is possible to adopt the same constitution as the first modification. That is, it is possible to make the hole diameter of the second cooling passage 45 smaller than the hole diameter of the first cooling passage 44, and make the hole pitch of the second cooling passage 45 in the rotation direction R smaller than the hole pitch of the first cooling passage 44 in the rotation direction R.

By selecting the hole diameter and hole pitch of the respective cooling passages so that the amounts of cooling air that flows through the first cooling passage and the second cooling passage are balanced, it is possible to raise the cooling effect of the main body of the segment body. As a result, since it is possible to reduce the amount of cooling air compared with the first embodiment, the thermal efficiency of the gas turbine is further improved.

Third Embodiment

Figure 10:
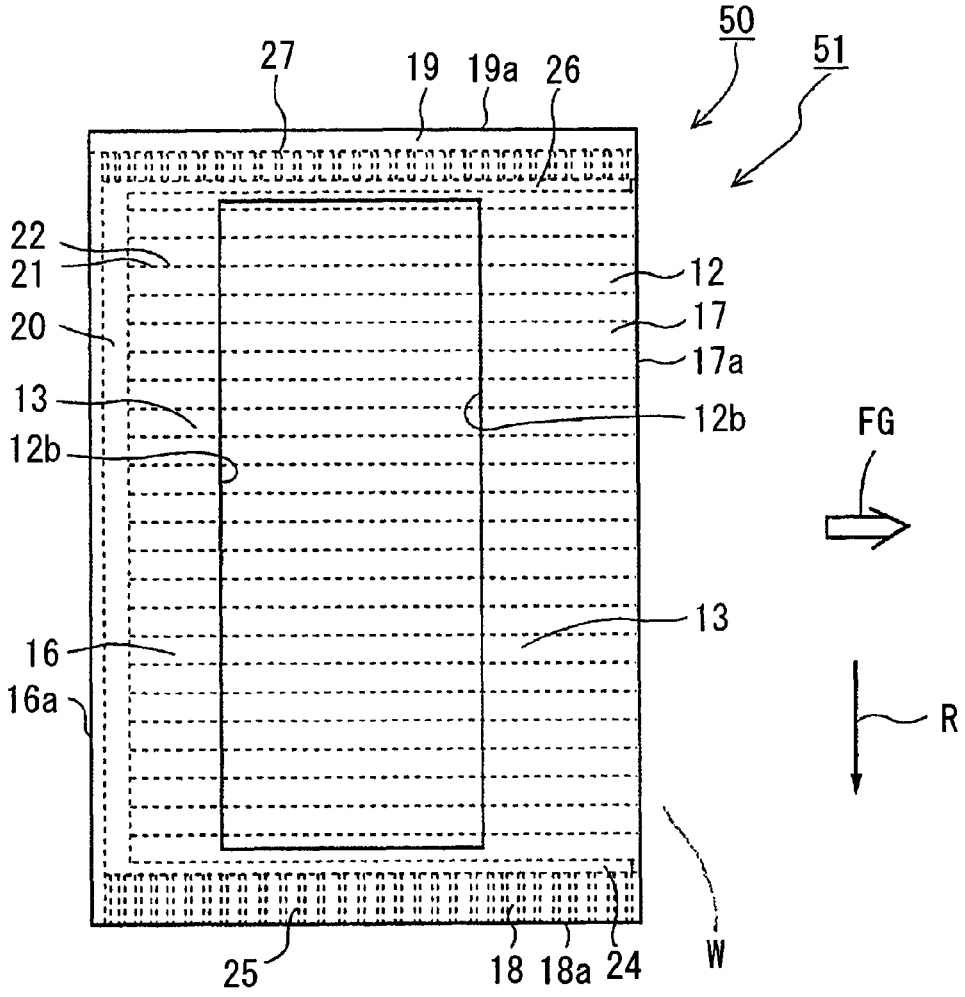
FIG. 10 is a plan view of the segment body of the third embodiment.

FIG. 10 shows a plan view of the segment body according to the third embodiment.

Compared to the first embodiment, the cooling system of the side end portion of the segment body of the ring segment of the present embodiment is different, but other constitutions are the same as the first embodiment.

Note that the component elements that are in common with the first embodiment use the same component names and reference numbers as the first embodiment, and detailed descriptions thereof shall be omitted.

In the present embodiment, a second cavity 24 and a third cavity 26 communicate with the first cavity 20 on the upstream in the gas flow direction of the combustion gas, and communicate with the third cooling passage 25 and the fourth cooling passage 27 on the downstream. That is, the present embodiment differs from the first embodiment on the point of the third cooling passage 25 and the fourth cooling passage 27 being connected to the cooling space 29 via the first cavity 20, the second cavity 24 and the third cavity 26 without being directly coupled to the cooling space 29.

According to the present embodiment, the cooling performance of the third cooling passage 25 and the fourth cooling passage 27 in the vicinity of the upstream end portion 16 is enhanced compared to the first embodiment. That is, the cooling air CA is supplied from the cooling space 29 to the first cavity 20, and is introduced from the first cavity 20 to the second cavity 24 and the third cavity 26. Furthermore, when discharging the cooling air CA from the second cavity 24 or the third cavity 26 to the combustion gas space W through the third cooling passage 25 or the fourth cooling passage 27, it carries out convection cooling of the side edge portions 18 and 19.

In particular, the upstream end portion 16 that is at the upstream of the flow direction of combustion gas is readily exposed to high temperature combustion gas. In order to enhance the cooling performance of the side edge portions 18 and 19, it is desirable to quicken the flow velocity by raising the pressure of the cooling air that flows through the third cooling passage 25 or the fourth cooling passage 27 in the vicinity of the upstream end portion 16 of the side edge portions 18 and 19.

However, in the case of the first embodiment, since the end of the second cavity 24 or the third cavity 26 that extend toward the upstream end face 16*a* is blocked, the terminal pressure in the cavity is hindered from increasing. For that reason, there is a limit to increasing the flow velocity of the cooling air that flows through the third cooling passage 25 or the fourth cooling passage 27 that communicates with the second cavity 24 or the third cavity 26.

On the other hand, in the present embodiment, since the second cavity 24 and the third cavity 26 are directly coupled to the first cavity 20 that is held at a high pressure, the pressure of the cooling air in the vicinity of the upstream end portion 16 is held at a high pressure. Accordingly, the flow velocity of the cooling air that flows through the third cooling passage 25 or the fourth cooling passage 27 in the vicinity of the upstream end portion 16 that are in communication with these is maintained at a high velocity, and the convection cooling is enhanced. Note that depending on the running condition of the gas turbine, for cooling of the side end portion it is possible to provide only the third cooling passage connected to the first cavity via the second cavity, and the fourth cooling passage need not be provided.

According to the cooling system of the ring segment of the aforementioned invention, it is possible to keep down the amount of cooling air used to the minimum extent, and it is possible to further raise the cooling efficiency and the cooling performance of the segment body 11 and the ring segment 10 that has it as a component element. Note that the present invention is not limited to the aforementioned embodiments, and it is possible to make suitable changes within the scope that does not depart from the spirit of the present invention.

While preferred embodiment of the invention has been described and illustrated above, it should be understood that this is exemplary example of the invention and is not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A cooling system of ring segment that is formed from a plurality of segment bodies that are arranged in the circumferential direction to form a ring shape, and that cools a ring segment of a gas turbine that is arranged in a casing so that the inner peripheral surface is kept a fixed distance from the tips of turbine blades, comprising:

a collision plate that has a plurality of small holes;

a cooling space that is enclosed by the collision plate and a main body of the segment body;

a first cavity that is arranged in the upstream end portion of the segment body in the flow direction of the combustion gas so as to be perpendicular to the axial direction of a rotating shaft;

a first cooling passage that communicates from the cooling space to the first cavity;

a second cooling passage that is provided in a position of the segment body other than a side end portion on the downstream and upstream of the segment body in the rotation direction of the rotating shaft, and communicates from the first cavity to a combustion gas space in the downstream end portion of the segment body in the flow direction of the combustion gas; and a third cooling passage that is arranged at a side end portion on the upstream of the segment body in the rotation direction of the rotating shaft, and that communicates from the cooling space to the combustion gas space in the side end portion, wherein the third cooling passage communicates with the first cavity via a second cavity.

2. The cooling system of ring segment according to claim 1, wherein the first cooling passage and the second cooling passage have a structure of turning back in the axial direction of the rotating shaft in the first cavity, and the second cooling passage passes the main body of the segment body in the axial direction of the rotating shaft from the first cavity, and opens on the surface of the down stream end portion of the segment body.

3. The cooling system of ring segment according to claim 1, wherein the first cooling passage and the second cooling passage each is arranged in a plurality in an annular shape with respect to the rotation direction of the rotating shaft, and is arranged so as to be mutually parallel in the radial direction.

4. The cooling system of ring segment according to claim 1, wherein the first cooling passage and the second cooling passage are arranged in a plurality in an annular shape with respect to the rotation direction of the rotating shaft, and the first cooling passage is arranged sloping in the rotation direction of the rotating shaft with respect to the second cooling passage.

5. The cooling system of ring segment according to claim 1, wherein the first cooling passage has a shorter length than the second cooling passage and, at the upstream end portion of the segment body in the flow direction of the combustion gas, is disposed further to the outer circumferential surface side of the main body of the segment body than the second cooling passage.

6. The cooling system of ring segment according to claim 1, wherein the hole diameter of the second cooling passage is smaller than the hole diameter of the first cooling passage.

7. The cooling system of ring segment according to claim 1, wherein the hole pitch of the second cooling passage in the rotation direction of the rotating shaft is smaller than the hole pitch of the first cooling passage in the rotation direction of the rotating shaft.

8. A gas turbine provided with the cooling system of ring segment according to any one of claims 1 to 7.

9. A cooling system of ring segment that is formed from a plurality of segment bodies that are arranged in the circumferential direction to form a ring shape, and that cools a ring segment of a gas turbine that is arranged in a casing so that the inner peripheral surface is kept a fixed distance from the tips of turbine blades, comprising:

a collision plate that has a plurality of small holes;

a cooling space that is enclosed by the collision plate and a main body of the segment body;

a first cavity that is arranged in the upstream end portion of the segment body in the flow direction of the combustion gas so as to be perpendicular to the axial direction of a rotating shaft;

a first cooling passage that communicates from the cooling space to the first cavity;

a second cooling passage that is provided in a position of the segment body other than a side end portion on the downstream and upstream of the segment body in the rotation direction of the rotating shaft, and communicates from the first cavity to a combustion gas space in the downstream end portion of the segment body in the flow direction of the combustion gas; and a fourth cooling passage that is arranged at the side end portion on the downstream of the segment body in the rotation direction of the rotating shaft, and that communicates from the cooling space to the combustion gas space in the side end portion, wherein the fourth cooling passage communicates with the first cavity via a third cavity.

10. The cooling system of ring segment according to claim 9, wherein the first cooling passage and the second cooling passage have a structure of turning back in the axial direction of the rotating shaft in the first cavity, and the second cooling passage passes the main body of the segment body in the axial direction of the rotating shaft from the first cavity, and opens on the surface of the downstream end portion of the segment body.

11. The cooling system of ring segment according to claim 9, wherein the first cooling passage and the second cooling passage each is arranged in a plurality in an annular shape with respect to the rotation direction of the rotating shaft, and is arranged so as to be mutually parallel in the radial direction.

12. The cooling system of ring segment according to claim 9, wherein the first cooling passage and the second cooling passage are arranged in a plurality in an annular shape with respect to the rotation direction of the rotating shaft, and the first cooling passage is arranged sloping in the rotation direction of the rotating shaft with respect to the second cooling passage.

13. The cooling system of ring segment according to claim 9, wherein the first cooling passage has a shorter length than the second cooling passage and, at the upstream end portion of the segment body in the flow direction of the combustion gas, is disposed further to the outer circumferential surface side of the main body of the segment body than the second cooling passage.

14. The cooling system of ring segment according to claim 9, wherein the hole diameter of the second cooling passage is smaller than the hole diameter of the first cooling passage.

15. The cooling system of ring segment according to claim 9, wherein the hole pitch of the second cooling passage in the rotation direction of the rotating shaft is smaller than the hole pitch of the first cooling passage in the rotation direction of the rotating shaft.

16. A gas turbine provided with the cooling system of ring segment according to any one of claims 9 to 15.

* * * * *